US006295028B1

(12) United States Patent
Jonsson et al.

(10) Patent No.: US 6,295,028 B1
(45) Date of Patent: Sep. 25, 2001

(54) DUAL BAND ANTENNA

(75) Inventors: Stefan Jonsson, Stocksund; Dan Karlsson, Solna, both of (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/336,744

(22) Filed: Jun. 21, 1999

(30) Foreign Application Priority Data

Jun. 26, 1998 (SE) ..... 9802301

(51) Int. Cl.[7] ..... H01Q 1/38
(52) U.S. Cl. ..... 343/700 MS
(58) Field of Search ..... 343/700 MS, 810, 343/815, 841, 834

(56) References Cited

U.S. PATENT DOCUMENTS

| | | | | |
|---|---|---|---|---|
| 4,241,352 | * | 12/1980 | Alspaugh et al. | 343/700 MS |
| 5,043,738 | | 8/1991 | Shapiro et al. | 343/700 |
| 5,087,920 | * | 2/1992 | Tsurumaru et al. | 343/700 MS |
| 5,422,649 | | 6/1995 | Huang | 343/700 |
| 5,572,222 | | 11/1996 | Mailandt et al. | 343/700 |
| 5,661,493 | | 8/1997 | Uher et al. | 343/700 |
| 5,729,237 | | 3/1998 | Webb | 343/700 |
| 5,815,119 | * | 9/1998 | Helms et al. | 343/700 MS |
| 5,896,107 | * | 4/1999 | Huynh | 343/700 MS |
| 5,952,983 | * | 9/1999 | Dearnley | 343/817 |
| 6,008,763 | * | 12/1999 | Nystrom et al. | 343/700 MS |
| 6,061,032 | * | 5/2000 | Sandstedt et al. | 343/770 |

FOREIGN PATENT DOCUMENTS

| | | |
|---|---|---|
| 9704642-9 | 9/1999 | (SE) . |
| WO97/43799 | 11/1997 | (WO) . |

* cited by examiner

*Primary Examiner*—Hoanganh Le
*Assistant Examiner*—Trinh Vo Dinh
(74) *Attorney, Agent, or Firm*—Jacobson Holman, PLLC

(57) ABSTRACT

A dual band antenna with dual antenna elements, each including a first and a second antenna element (5*b*, 6*b*), for transmitting and/or receiving radio frequency radiation in a first, relatively low frequency band and a second, relatively high frequency band, respectively, and an electrically conductive, substantially planar reflector device (1). Each first antenna element (5*b*) is located close to an associated one (6*b*) of the second antenna elements on a front side of the reflector device so as to define first and second radiation beams. The reflector device, on each lateral side thereof, is provided with an edge portion formed as a groove (11, 12), which is open towards the front side of the reflector device and which is dimensioned so as to widen the azimuth beam width of the second beam to an angular value being close to that of the first beam, whereby both beams will have substantially the same azimuth width.

8 Claims, 2 Drawing Sheets

DUAL BAND ANTENNA

BACKGROUND OF THE INVENTION

FIELD OF THE INVENTION

The present invention relates to a dual band antenna, comprising at least one first antenna element and an associated second antenna element for transmitting and/or receiving radio frequency radiation in a first, relatively low frequency band and a second, relatively high frequency band, respectively, and an electrically conductive, substantially planar reflector device, the at least one first antenna element being located close to the associated second antenna element so as to form at least one combined antenna element on a front side of the reflector device and to define first and second radiation beams, respectively, each having a specific azimuth beam width being substantially symmetrical with respect to a central, longitudinal plane oriented perpendicularly to the planar reflector device and extending through the at least one combined antenna element.

Recently, the demand for antennas for mobile wireless applications has increased dramatically, and there are now a number of land and satellite based systems for wireless communications using a wide range of frequency bands. Accordingly, there is also a need for antennas being operable in two or more frequency bands, preferably also with dual polarization in order to accomplish a desired diversity of the radio frequency radiation received by the antenna. Such dual band, dual polarized antennas are especially useful in base station antennas.

Due to the capacity problems encountered in the existing AMPS-800 and GSM-900 MHz systems, many operators have recently aquired licenses for the DCS-1800 or PCS-1900 MHz band as well, i.e. a much higher frequency band which is widely separated from the lower frequency band by approximately an octave. Therefore, in order to make use of the existing sites for the new frequency bands, a favorable way of implementing the new systems is to replace the existing GSM or AMPS antennas by dual band antennas operable, e.g., in the dual bands GSM/DCS or AMPS/PCS.

A dual band antenna of the kind mentioned in the first paragraph is disclosed in the Swedish patent application 9704642-9 (Allgon AB), wherein each dual or combined antenna element comprises aperture coupled, planar, mutually parallel patches being placed one on top of the other and being centered in relation to a central point of a cross-shaped aperture in a ground plane layer serving as a reflector device. Microwave power is fed from a feed network in two separate frequency bands, the microwave power in a first frequency band being fed via the aperture in the reflector device to a first radiating patch, and the microwave power in a second frequency band (the higher band) being fed via the aperture in the reflector device and via a coupling patch and a likewise cross-shaped aperture in the first radiating patch to a second radiating patch, which is smaller and operates in the higher frequency band.

Such an antenna structure with combined antenna elements has turned out to be very advantageous in production and use. However, a practical problem has arisen with regard to the width of the radiating beams on the front side of the antenna. Because of the different wavelengths, e.g., 0.326 m and 0.167 m, respectively, the width of each beam in azimuth, measured as the half power limit (−3dB), will be quite different from one another, the beam in the lower frequency band being much wider than the beam in the higher frequency band.

SUMMARY OF THE INVENTION

Accordingly, a main object of the present invention is to provide a dual band antenna structure which enables a modification of the beam width in the higher frequency band, in particular so as to become close to the beam width in the lower frequency band.

Other secondary objects are to provide an antenna structure which is easy to implement in serial production and which is well suited for practical use in base stations operating in at least two frequency bands, including bands having center frequencies in the regions 800–950 MHz and 1750–1950 MHz. Still another object is to achieve a more favorable front to back ratio of the radiated power.

The main object stated above is achieved, according to the present invention, in that the reflector device, on each lateral side thereof, is provided with an edge portion formed as a groove, which is open towards the front side of the reflector device and which is dimensioned so as to widen the beam width of the second beam (in the higher frequency band), in particular to an angular value being close to that of the first beam (in the lower frequency band). The widening of the beam in the higher frequency band is caused by a secondary radiation, with a horizontal electrical field component, from the edge portions of the reflector device.

The exact configuration and dimensions of the grooves are of course dependent on the particular frequency bands being used, the configuration of the combined antenna elements, the configuration of the reflector device, and the geometry and material of the cover or radome normally mounted as a protective cover on the front side of the antenna.

As a general rule, however, tests have shown that the depth of the groove should be 0.1 to 0.3 times the wavelength of the radiation of the second frequency band (the higher frequency band) and the width of the groove should be about 0.2 times the above-mentioned wavelength. Normally, the groove has such dimensions that it has only a minor effect on the width and other properties of the beam in the first frequency band (the lower frequency band). A typical lateral width of the whole reflector device is 0.2 to 0.3 m, in particular about 0.25 m–0.28 m for an antenna with a 70° azimuth beam width (or about 1.5 times the wavelength in the higher frequency band) and the width of each longitudinal groove at the edges of the reflector is about 0.033 m (or about 0.2 times the wavelength in the higher frequency band).

The geometrical configuration of the grooves can be selected as desired by those skilled in the art, e.g., with a rectangular, arcuate or V-formed cross-section. For practical reasons, the groove is preferably defined by longitudinally extending, substantially planar wall portions, such as two side wall portions and an intermediate bottom wall portion, obtained by bending of a metallic sheet material, such as aluminium, preferably in one piece with the rest of the reflector device.

In a particular embodiment, which has been tested and proven to give excellent performance, the central portion of the reflector device, between the edge portions being formed as grooves, is limited laterally or sideways by lateral, up-standing wall portions and longitudinally along a linear array of seven dual antenna elements (stacked patches) by metallic (aluminium) shield wall elements extending transversely in the region between each pair of adjacent dual elements in the linear array. The total length of this antenna, including the frontal radome, is 1.2 m, the total width thereof being 0.3 m and the depth or thickness thereof being 0.11 m.

The invention will now be explained further with reference to the appended drawings illustrating the above-mentioned preferred embodiment of the dual band antenna.

DESCRIPTION OF THE INVENTION

Figure 1:
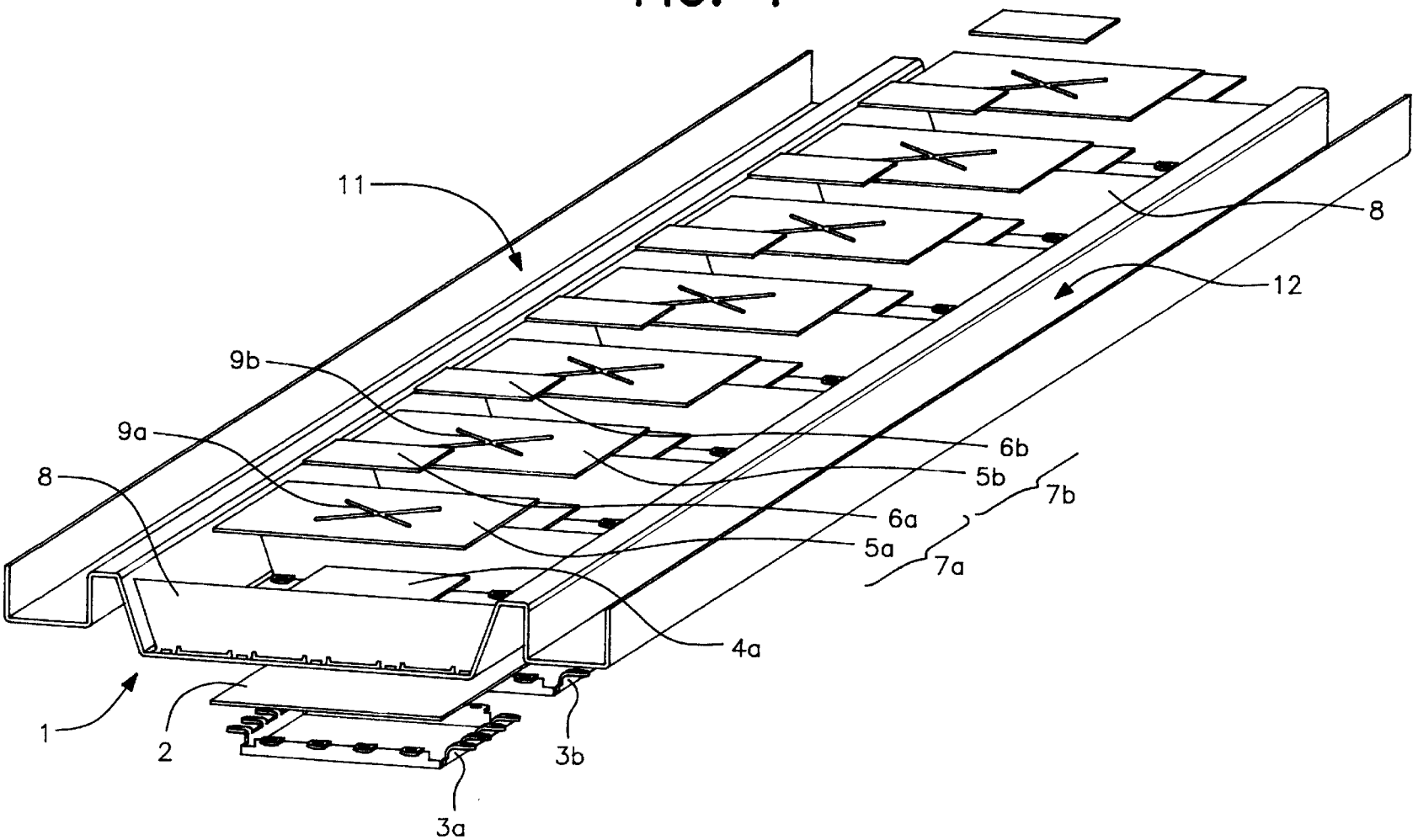
FIG. 1 shows schematically, in a perspective, exploded view, the most essential parts of the antenna (two feed cables and a protective front cover or radome being left out for clarity)
Figure 2:
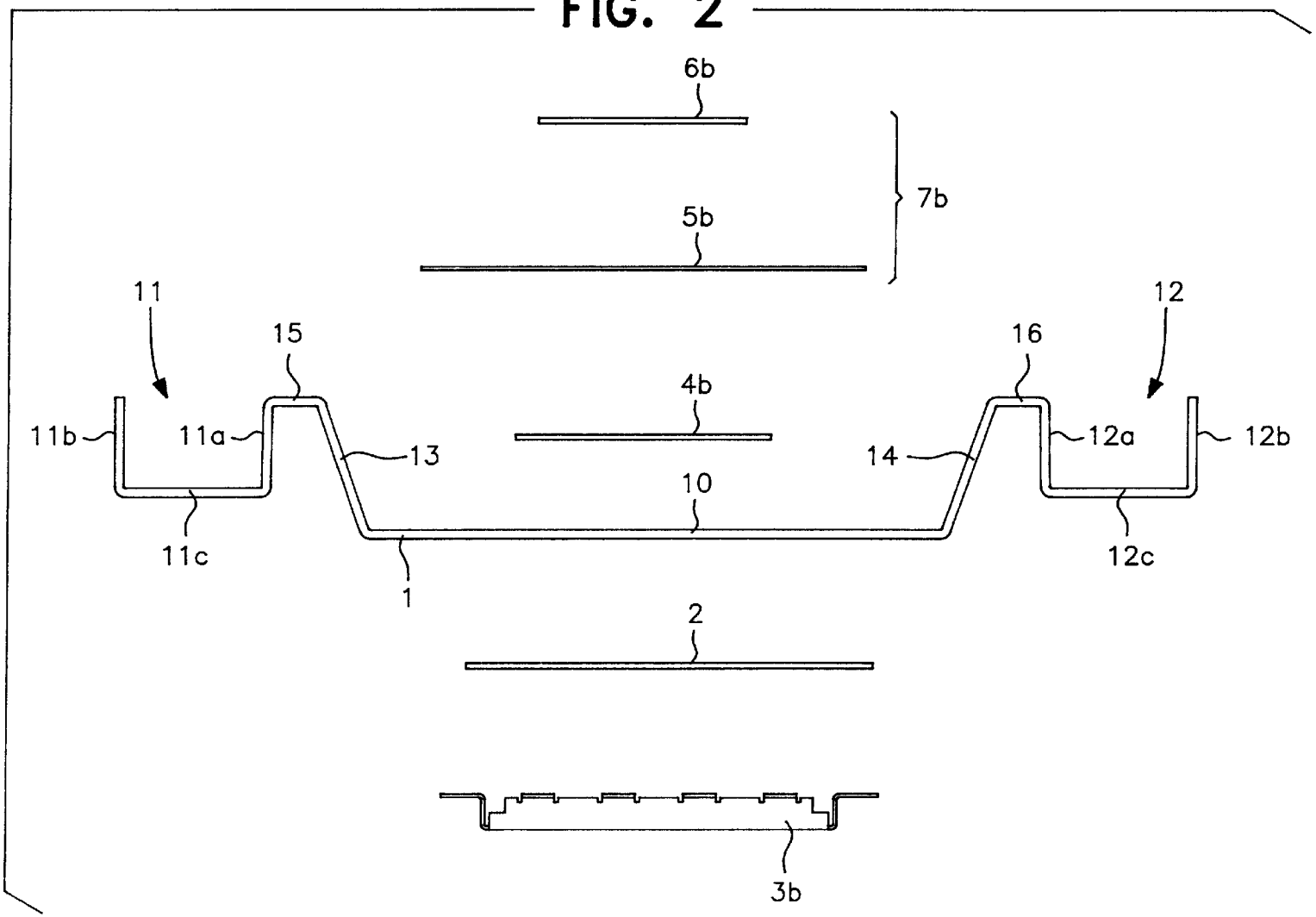
FIG. 2 shows, likewise in an exploded view, a transverse cross-section of the antenna shown in FIG. 1, at the second antenna element.

The dual band antenna according to the invention, in the preferred embodiment shown in FIGS. 1 and 2, consists essentially of a ground plane layer serving as a reflector device 1, a feed network (not shown specifically) formed on the lower side of a substrate layer 2, electrically conducting shield cages 3*a*, 3*b*, etc. serving to prevent microwave propagation backwards (downwards in FIGS. 1 and 2), and coupling and radiating patches 4*a*, 5*a*, 6*a*; 4*b*, 5*b*, 6*b*; etc. constituting dual or combined antenna elements 7*a*, 7*b*, etc. being mounted in a linear array along the longitudinal axis of the elongated antenna.

Each combined antenna element, e.g. the element 7*b* visible in FIG. 2, is of the general kind described in the above-mentioned Swedish patent application 9704642-9, i.e. comprising two planar, mutually parallel radiating patches 5*b*, 6*b* being fed with microwave power from the feed network on the substrate 2 via a cross-shaped aperture (not visible in FIG. 1) in the ground plane layer or reflector 1, there being one part of the network and an associated feed cable feeding power in one linear polarization (slanted +45°) and another part of the network and an associated feed cable feeding power in an orthogonal polarization (slanted −45°). The microwave power is supplied in two separate frequency bands, namely a lower band 880–960 MHz (GSM) and an upper band 1710–1880 MHz (DCS), the power in the lower band being fed to the somewhat larger patch 5*b*, from which it is radiated generally upwards (in the drawing figures) in a well-defined beam, and the power in the upper band being fed to the smaller patch 6*b*, from which it is radiated generally upwards, likewise in a well-defined beam.

The microwave power in the upper band, which is to be radiated from the patch 6*b*, is transferred from the feed network via a cross-shaped aperture 9*b* (FIG. 1) in the radiating patch 5*b*, as explained in the above-mentioned Swedish patent application 9704642-9, the disclosure thereof being included herein by reference. The intermediate, relatively small patch 4*b*, having approximately the same dimensions as the relatively small radiating patch 6*b*, serves as a coupling member which is necessary for the transfer of microwave power from the feed network to the radiating patch 6*b*.

The substrate layer 2 is made of a teflon material, e.g., of the kind denoted DICLAD 527, and the patches located on top of each other are separated by spacing elements (not shown) or, alternatively, a foam material (not shown), e.g., of the kind denoted ROHACELL.

Dual polarization and accompanying diversity is achieved in each band by way of orthogonal linear polarization obtained by excitation of the respective, mutually perpendicular slots in each aperture (not shown) in the reflector device, the slots being slanted 45° in opposite directions relative to the central longitudinal axis of the antenna. The linear polarization, which is perpendicular to the respective slot, will also be oriented cross-wise with a corresponding slant of 45°.

The spacing between the smaller radiating patches 6*a*, 6*b*, etc., operating in the upper band, is approximately one wavelength, i.e. about 0.17 m, and the spacing between the larger radiating patches 5*a*, 5*b*, etc. is of course the same in absolute length units (but smaller in terms of wavelengths), since the patches in each combined antenna element are centered in relation to each other and in relation to the center of the asssociated cross-shaped aperture.

Measurements have shown that the input return loss, the isolation between the dual polarized channels and the two frequency bands as well as the radiation properties and gain all have very good values. Specifically, it has turned out that the cross-polarization level in the slant 45° antenna has been substantially reduced due to the fact that the horizontal and vertical field components both have approximately the same beam width. Also, the front to back ratio of the radiated power has been improved, especially in the upper band. The inter-channel isolation (each channel corresponding to a certain polarization) has been improved, primarily by means of metallic shield wall elements 8 (FIG. 1) mounted transversely in the region between each pair of adjacent dual antenna elements.

The inter-channel isolation has also been advantageously affected by making the radiating patches slightly rectangular, i.e. not exactly square, with one side edge about 1 to 5% longer than the other side edge.

Moreover, in accordance with the present invention, the width of the beams radiated from the antenna towards the front side thereof (upwards in the drawing figures) is virtually the same in the two separate frequency bands. Thus, in both bands, the beam width is 72° in azimuth, or 36° symmetrically on both sides from a central, longitudinal plane being perpendicular to the plane of the reflector 1 through the central points of the various patches and the cross-shaped apertures.

The coinciding beam widths have been achieved by a specific configuration of the reflector device 1 at the longitudinal edge portions thereof, viz. in the form of longitudinally extending grooves 11, 12 on each lateral side of the reflector device 1. These grooves 11, 12 are open or face towards the front side of the antenna (upwards in the drawing figures) and are defined by substantially planar wall portions, viz. side wall portions 11*a*, 11*b*; 12*a*, 12*b* and an intermediate bottom wall portion 11*c*; 12*c*, formed by bending the metal sheet material of the reflector 1, which is thus formed in one integral piece.

The central portion 10 of the reflector device 1 is planar and carries the patches (4*b*, 5*b*, 6*b* in FIG.2) on the front side and the substrate layer and the shield cages (2 and 3*b* in FIG. 2) on the back side. The central, planar portion 10 merges with upwardly projecting, outwardly slightly inclined wall portions 13, 14 and horisontal wall portions 15, 16, which in turn merge with the wall portions 11*a*, 12*a* defining the inner wall of the respective groove.

The dimensions of the grooves are in accordance with the specifications indicated in the first, general part of the description, the width of each groove being 33.5 mm and the depth thereof being 22 mm. With such dimensions, it has turned out that the beam width in the upper band, having a center frequency wavelength of 167 mm, is substantially enlarged so as to coincide with that of the lower band, having a center frequency wavelength of 326 mm. The beam width of the lower band is not very much affected by the relatively small irregularities of the grooves 11, 12 but is rather determined by the total width of the reflector device, this total width being 265 mm in the illustrated example. As appears from FIG. 2, the bottom wall portions 11*c*, 12*c* of the grooves are slightly elevated in relation to the central portion 10 of the reflector device 1.

The dual band antenna according to the invention can be modified considerably within the scope of the appended claims. Thus, the particular shape and dimensions of the grooves 11, 12 can be varied. The grooves may alternatively be designed as separate metal elements mounted on each lateral side of the reflector device.

The radiating patches 5*b*, 6*b* can be replaced by other kinds of dual or combined antenna elements, such as dipole structures. Moreover, the antenna can be provided with only one combined antenna element instead of a linear array.

The central portion 10 of the reflector device may be formed of a synthetic material, e.g., teflon, coated with an electrically conductive material.

Finally, circular polarization may be used instead of cross polarization provided that the two feed channels are combined by a quadrature hybrid wide band branch-line coupler.

What is claimed is:

1. A dual band antenna, comprising:

at least one first antenna element and a corresponding second antenna element for forming at least one combined antenna element and transmitting and/or receiving radio frequency radiation in a first, relatively low frequency band and a second, relative high frequency band, respectively, an electrically conductive, substantially planar reflector device having a front side, said at least one first antenna element being located close to said corresponding second antenna element so as to form said at least one combined antenna element on said front side of said planar reflector device and to define first and second radiation beams, respectively, each having a specific azimuth radiation beam width being substantially symmetrical with respect to a central, longitudinal plane oriented perpendicularly to said planar reflector device and extending through said at least one combined antenna element, said planar reflector device, on each lateral side of said central, longitudinal plane, is provided with an edge portion formed as a groove, which is open towards said front side of said reflector device, said groove being dimensioned so as to widen the azimuth radiation beam width of said second radiation beam, and said grooves having a depth and a width, the depth of said groove being 0.1 to 0.3 times the wavelength of the radiation in said second, relatively high frequency band and the width of said groove being 0.1 to 0.3 times the wavelength of the radiation in said second, relatively high frequency band; and wherein the azimuth radiation beam width of said second beam is widened to an angular value being close to that of said first radiation beam, whereby both radiation beams will nearly match and have substantially the same radiation azimuth beam width.

2. The antenna as defined in claim 1, wherein said at least one combined antenna element comprises at least two patch elements.

3. The antenna as defined in claim 2, wherein said patch elements are stacked one on top of the other in each combined antenna element.

4. The antenna as defined in claim 1, wherein said at least one combined antenna element comprise at least two elements arranged in a linear array along said central, longitudinal plane.

5. The antenna as defined in claim 4, wherein metallic shield wall elements extend transversely in a region between adjacent combined antenna elements in said linear array.

6. The antenna as defined in claim 1, wherein said groove at each edge portion is defined by longitudinally extending, substantially planar wall portions.

7. The antenna as defined in claim 6, wherein said wall portions comprise two side wall portions and a bottom wall portion.

8. The antenna as defined in claim 1, wherein a center frequency of said first frequency band is in the region 800–950 MHz and a center frequency of said second frequency band is in the region 1750–1950 MHz, and the total width of said reflector device, including said grooves at the longitudinal edges thereof, is 0.2 to 0.3 m.

* * * * *